US008689851B2

(12) United States Patent
Morlacchi

(10) Patent No.: US 8,689,851 B2
(45) Date of Patent: Apr. 8, 2014

(54) PROCESS AND MACHINE FOR WATER PROOFING SEMIMANUFACTURED FOOTWEAR, CLOTHING ITEMS AND ACCESSORIES, AND SEMIMANUFACTURED PRODUCTS OBTAINED WITH SAID PROCESS OR MACHINE

(75) Inventor: Luca Morlacchi, Legnano (IT)

(73) Assignee: OutDry Technologies Corporation, Portland, OR (US)

( * ) Notice: Subject to any disclaimer, the term of this patent is extended or adjusted under 35 U.S.C. 154(b) by 332 days.

(21) Appl. No.: 12/782,268

(22) Filed: May 18, 2010

(65) Prior Publication Data

US 2010/0236721 A1 Sep. 23, 2010

Related U.S. Application Data

(62) Division of application No. 10/559,967, filed as application No. PCT/IT2004/000351 on Jun. 18, 2004, now Pat. No. 7,758,713.

(30) Foreign Application Priority Data

Jun. 20, 2003 (IT) ..... MI2003A1258

(51) Int. Cl.
*B29C 63/02* (2006.01)

(52) U.S. Cl.
USPC ..... 156/583.3; 156/381; 156/382

(58) Field of Classification Search
USPC ..... 156/583.7, 583.9, 583.8, DIG. 36, 156/DIG. 51, 311, 345.37, 345.52, 359, 156/380.9, 583.3, 382, 213, 212, 196, 381; 36/4, 12, 14, 10, 55; 12/142 A, 142 R, 12/142 RS, 142 T, 146 C; 425/395, 408, 425/414, 417, 442, 457, 451.7, 468, 181, 425/249, 183, 186
See application file for complete search history.

(56) References Cited

U.S. PATENT DOCUMENTS

| | | | | |
|---|---|---|---|---|
| 692,038 | A * | 1/1902 | Strub | 65/357 |
| 1,096,949 | A * | 5/1914 | Reed | 12/117.2 |
| 1,389,283 | A * | 8/1921 | Zawadzki | 264/325 |
| 2,211,247 | A | 8/1940 | Victor et al. | |
| 2,651,857 | A | 9/1953 | Griswold et al. | |
| 3,345,661 | A * | 10/1967 | Wilisch | 12/54.3 |
| 4,575,889 | A | 3/1986 | Roseland et al. | |

(Continued)

FOREIGN PATENT DOCUMENTS

| | | |
|---|---|---|
| DE | 10031827 C1 | 6/2000 |
| GB | 2290455 | 1/1996 |

(Continued)

*Primary Examiner* — Christopher Schatz
*Assistant Examiner* — John Blades
(74) *Attorney, Agent, or Firm* — Schwabe, Williamson & Wyatt, P.C.

(57) ABSTRACT

A machine for waterproofing semimanufactured products including footwear, clothing items, and accessories. The machine has a pressing device with at least one pair of deformable plates that have a hollow body. The pressing surface is elastic and suitable for being urged outwards by a fluid pressure. At least one of the deformable plates is fixed in a mobile manner to a support structure for opening or closing the pressing device around at least one shaped support which is provided with transport means to and from the pressing device and is suitable for supporting the semimanufactured product during the pressing with at least one waterproofing sheath.

24 Claims, 3 Drawing Sheets

(56) References Cited

U.S. PATENT DOCUMENTS

| | | | | |
|---|---|---|---|---|
| 4,593,692 | A * | 6/1986 | Flowers | 606/202 |
| 4,924,546 | A * | 5/1990 | Price et al. | 12/7.1 |
| 5,244,716 | A | 9/1993 | Thornton et al. | |
| 5,253,434 | A | 10/1993 | Curley, Jr. et al. | |
| 5,477,577 | A * | 12/1995 | Hadley | 12/142 R |
| 5,685,091 | A | 11/1997 | Yalamanchili | |
| 5,928,597 | A | 7/1999 | Van Ert | |
| 5,983,524 | A | 11/1999 | Polegato | |
| 6,065,227 | A | 5/2000 | Chen | |
| 6,497,786 | B1 * | 12/2002 | Kilgore et al. | 156/379.8 |
| 6,539,552 | B1 * | 4/2003 | Yoshida | 2/161.6 |
| 6,841,757 | B2 * | 1/2005 | Marega et al. | 219/211 |
| 7,356,946 | B2 | 4/2008 | Hannon et al. | |
| 2002/0189755 | A1 * | 12/2002 | Calmidi et al. | 156/311 |
| 2004/0025221 | A1 * | 2/2004 | Clark | 2/159 |

FOREIGN PATENT DOCUMENTS

| | | |
|---|---|---|
| RU | 2195806 | 1/2003 |
| WO | 0022948 | 4/2000 |
| WO | 0211571 | 2/2002 |
| WO | WO 0211571 A1 * | 2/2002 |

* cited by examiner

PROCESS AND MACHINE FOR WATER PROOFING SEMIMANUFACTURED FOOTWEAR, CLOTHING ITEMS AND ACCESSORIES, AND SEMIMANUFACTURED PRODUCTS OBTAINED WITH SAID PROCESS OR MACHINE

This application is a Divisional application of U.S. application Ser. No. 10/559,967 filed Dec. 7, 2005, which in turn is a 371 of PCT/IT04/00351 filed November Jun. 18, 2004, which in turn claims priority of MI2003A001258 (IT) filed Jun. 20, 2003. The priority of these applications is hereby claimed and these applications are incorporated by reference herein.

BACKGROUND OF THE INVENTION

The present invention relates to a process for waterproofing semimanufactured footwear, clothing items and accessories, in particular during their manufacture. The present invention also relates to a machine that carries out said process, as well as the semimanufactured products obtained with said process or machine.

WO 00/22948 discloses a process for waterproofing leather and semimanufactured products made up of pieces of leather sewn to each other. This known process comprises a pressing onto the inner surface of the leather of at least one semipermeable membrane, whose surface contacting the leather is provided with a glue pattern. With this arrangement a suitable transpiration of the leather is achieved also in the zones where it is glued to the membrane.

WO 02/11571 discloses instead a process and a device for waterproofing semimanufactured products made of leather or fabric, also joined with other materials, which cannot be completely spread on a table since they have already taken during the manufacture a three-dimensional conformation with at least one inner surface and one outer surface. A typical example of said manufactured products is the uppers of footwear, considered in their final working step, before the application of an inner lining, if any. Other semimanufactured products of this kind can be boot uppers, gloves, hats and clothes in general in the final step of their manufacture. Said process comprises the inside out turning of the semimanufactured product and the introduction of a suitably shaped member before the pressing, so as to waterproof the semimanufactured product even if it has already taken a three-dimensional conformation. Said device includes instead a press provided with deformable plates made up of a hollow body having an elastic pressing surface urged outwards by hot air under pressure.

However, said known processes and device, so as they are disclosed in said patent applications, are not particularly suitable per se for an industrial application on a large scale, where a high automation degree is necessary for trying to reduce the manufacture times and costs.

SUMMARY OF THE INVENTION

It is therefore an object of the present invention to provide a process and a machine free from said disadvantages, i.e. which can be easily applied to an industrial production. Said object is achieved with a process and a machine, the main features of which are described in claims 1 and 18, respectively, while other features are described in the remaining claims.

Thanks to the use of the particular waterproofing sheath shaped and provided with glue, the process and the machine according to the present invention can waterproof the semimanufactured products in a simple and quick manner, so as to allow their automated production, especially if the glue is thermoactivable.

The machine according to the present invention is particularly suitable for the automated production thanks to the deformable plates which are pivoted to a support structure and can press a mobile shaped support suitable for supporting the semimanufactured product and the waterproofing sheath during the pressing.

According to a particular aspect of the invention, the deformable plates can rotate around a substantially vertical axis and the shaped member can run on horizontal rails, so that the operator can easily arrange the semimanufactured product and the waterproofing sheath on the same support.

According to another particular aspect of the invention, the machine is provided with two shaped supports which can be pressed alternately, so that while the first one is pressed, the second one is prearranged by the operator with the semimanufactured product and the waterproofing sheath, and vice versa, so as to double the productivity.

According to a further particular aspect of the invention, the devices for the movement of the mobile components of the machine are driven in a pneumatic manner, so as to simplify its maintenance and to improve its reliability. Further, the particular arrangement of the machine parts prevents the accidental access to the pressing device, so as to improve the overall security.

Another advantage of the process and the machine according to the present invention lies not only in their high productivity, but also in the relatively low costs for their carrying out, so that they can be employed not only in the industrial production, but also in the handicraft production, in particular of footwear.

BRIEF DESCRIPTION OF THE DRAWINGS

Further advantages and features of the process and the machine according to the present invention will become clear to those skilled in the art from the following detailed and non-limiting description of an embodiment thereof with reference to the attached drawings, wherein.

DETAILED DESCRIPTION OF THE INVENTION

Figure 1:
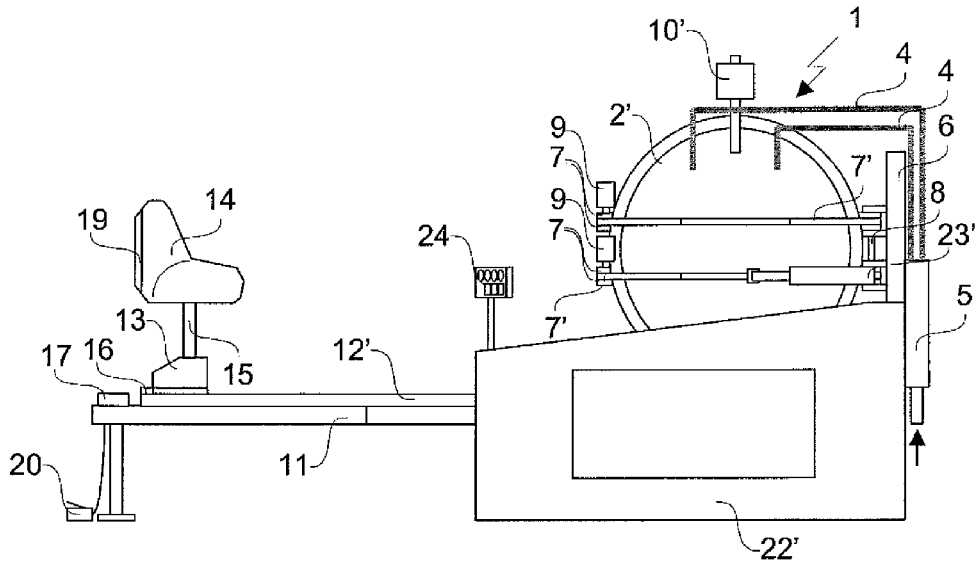
FIG. 1 shows a side view of said machine.
Figure 2:
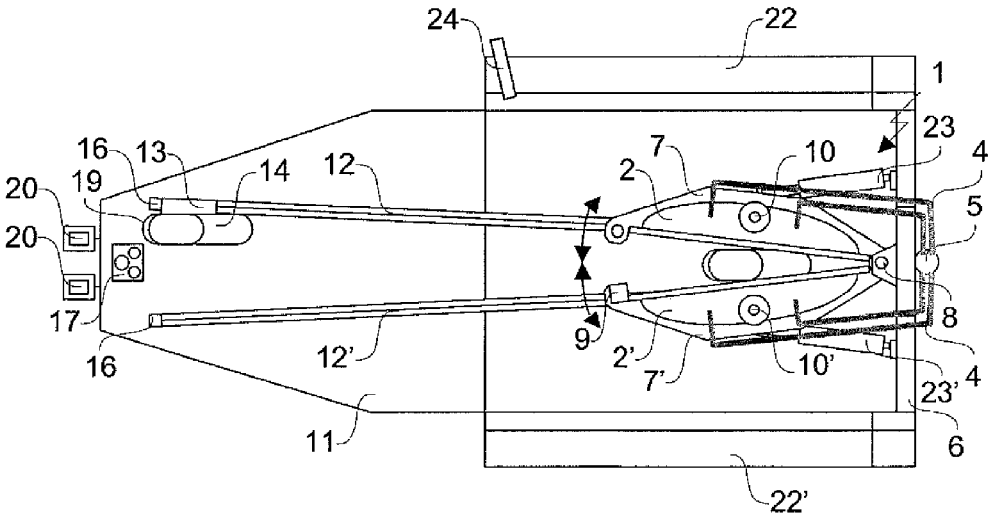
FIG. 2 shows a top view of the machine of FIG. 1.
Figure 3:
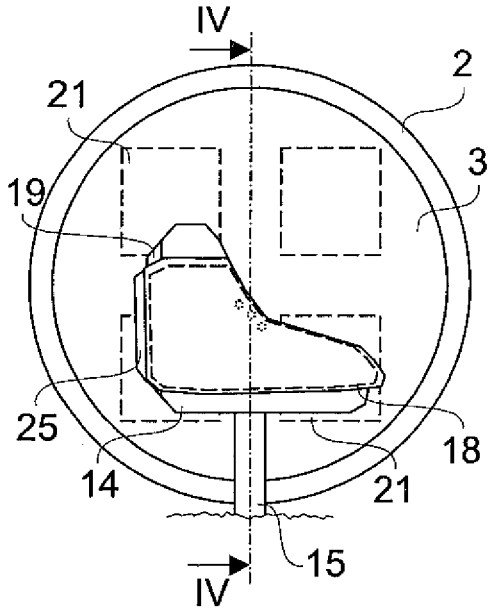
FIG. 3 shows a side view of the pressing device of the machine of FIG. 1.
Figure 4:
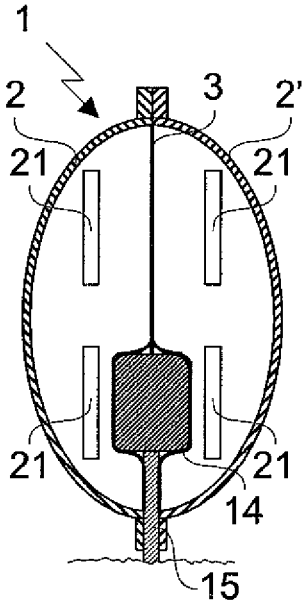
FIG. 4 shows a view sectioned along plane IV-IV of the pressing device of FIG. 3.

Referring to FIGS. 1 to 4, it is seen that the machine according to the present embodiment of the invention comprises in a known way a pressing device 1 having at least one pair of deformable plates 2, 2' made up of a hollow body, for example having the shape of a spherical cap, the pressing surface 3 of which is elastic, for instance made of silicone or another elastic, antiadherent and heat-resistant material. A fluid, in particular air, coming from a compressor (not shown in the figures) can be pumped through one or more inlet ducts 4 provided with pneumatic valves (not visible in the figures) into the deformable plates 2, 2', after it has been heated by at least one electric heat exchanger 5.

According to the invention, at least one of the deformable plates 2, 2' is pivoted to a vertical support structure 6 so as to rotate (in the direction of the arrows of FIG. 2) around a substantially vertical axis for opening or closing the pressing device 1 during the pressing steps. For this purpose, four arms 7, flat and curved, are fixed outside the deformable plate 2 and two arms 7', also flat and curved, are fixed outside the deformable plate 2 at suitable height so that each arm 7' is arranged between two of the four arms 7. The ends of arms 7, 7' close to the vertical support 6 are perforated, so that at least one pin 8, around which the deformable plates 2, 2' can rotate, can be inserted in the holes made at one of the two ends. In the present embodiment the deformable plates 2, 2' rotate around a single pin 8, i.e. around a same substantially vertical axis. The piston of one or more pneumatic cylinders 9 acting as bolts for locking the deformable plates 2, 2' when they are closed can penetrate into the holes arranged at the end of arms 7, 7' opposite to the support structure 6 and prevent their accidental opening due to the high pressure between the pressing surfaces 3. At the end of the pressing, the fluid contained in the deformable plates 2, 2' can be discharged outside through one or more outlet ducts 10, 10' provided with pneumatic valves (not visible in the figures) and means for cooling and/or dispersing the hot fluid.

The support structure 6 is joined at the end of a horizontal platform 11 on which at least one rail, preferably two rails 12, 12' converging toward the pressing device 1, are arranged. A carriage 13 driven in a pneumatic way can run on each rail 12, 12' for alternately transporting to the same central position between the deformable plates 2, 2' of the pressing device 1 two shaped supports 14 mounted onto carriages 13 by means of a flat rod 15. Pneumatic sensors 16 are arranged at the ends of rails 12, 12' for detecting the position of carriages 13. A control panel 17 arranged on platform 11 comprises two buttons for controlling the movement of carriages 13, as well as a security button for stopping the working of the whole machine.

The shaped supports 14 have a shape suitable for supporting a semimanufactured product made of leather or fabric having a three-dimensional conformation with at least one inner surface and one outer surface, for example the upper of a footwear (shown with broken lines in FIG. 3), which is preferably turned inside out before it is arranged around the shaped support 14, so that its inner surface is turned outside.

At least one waterproofing sheath 18 shaped for entirely or partially cover the inner surface, preferably turned inside out, of the semimanufactured product to be waterproofed, is in turn put on the latter, so as to waterproof it when the pressing device 1 hot-presses it. The outer surface of the shaped supports 14 is preferably provided with at least one elastic, anti-adherent and heat-resistant coating, in particular made of silicone, and is shaped so as to adhere to the surfaces of the semimanufactured product and to compensate their irregularities, if any, for example caused by accessories such as metal loops or double applique, which create thickness irregularities and contact discontinuities between the surfaces of the semimanufactured product and sheath 18.

The surface of sheath 18 turned toward the semimanufactured product is provided with a glue pattern which can be thermally activated by the heat of the pressing device 1 for the time necessary for the fusion of the glue and to its penetration into the material of the semimanufactured product. In another embodiment, the glue can be sprayed onto the semimanufactured product before the latter is coupled with sheath 18.

In the present embodiment the glue pattern is made up of a plurality of dots of polyurethane glue, having a diameter comprised between 0.1 mm and 2 mm and a density comprised between 10 dots/cm.sup.2 and 200 dots/cm.sup.2. In other embodiments of the present invention the glue pattern may be made up of glue sprayed or arranged according to dot matrixes, also with a random pattern, or along mutually parallel and/or perpendicular lines. Sheath 18 preferably comprises at least one membrane made up of a sheet of a semi-permeable material, for instance made of polyurethane, polytetrafluoroethylene, polyester or other polymers, the thickness of which is preferably comprised between 5 mm and 100 mm. In particular, the semi-permeable membrane of sheath 18 according to the present embodiment of the invention is made of polyurethane. Further, it is preferably elastic, with a coefficient of elongation higher than 50%, in particular 100%, and it is non-porous, since it carries out the passage of the water vapor by osmosis, and therefore, differently form the porous membranes, the water passage is prevented even when it is pulled or bent. The surface of sheath 18 which is not provided with the glue pattern is generally fastened to a support sheet which avoids its possible accidental breakage or bending before the application. Said sheet can be made of paper and can be detached after that sheath 18 has been adhered to the semimanufactured product. In other embodiments of the present invention, the support sheet can be made of different materials, for example fabric or a similar material, preferably elastic, and be firmly fastened to sheath 18 if it is desired that the semimanufactured product is internally lined at the end of the processing. Further information about the membrane used for sheath 18 is contained in WO 00/22948 and WO 02/11571.

The shaped supports 14 can be expanded for stretching the surfaces of the semimanufactured product and of sheath 18 before they are pressed, so as to avoid wrinkles For this purpose, each shaped support 14 comprises at least one mobile member 19 suitable to be pushed outside by one or more pneumatic cylinders arranged in the same support.

If the semimanufactured product to be waterproofed is the upper of a footwear, the shaped support 14, as in the present embodiment, is similar to a foot and the mobile member 19 is arranged in the position of the heel and is fixed preferably in a removable manner to the shaped support 14 so as to substitute it with other mobile members having different sizes, so as to adapt the shaped support 14 to shoe uppers having different sizes. The expansion of each shaped support 14 is controlled by a pedal 20, while it automatically retracts when carriage 13 goes back to the start position and activates sensor 16.

One or more heating members 21, for example electrically heated plates, are preferably arranged inside the deformable plates 2, 2' for further heating by conduction and convection the fluid contained therein, as well as the pressing surfaces 3 by irradiation.

A pair of vertical containers 22, 22' are arranged on both sides of the pressing device 1. Container 22 houses the control and security devices of the electric circuit for cheating the heat exchanger 5 and the heating members 21, while container 22' houses the control devices of the pneumatic circuit for driving the valves of the inlet ducts 4 and of the outlet ducts 10, 10, cylinders 9, carriages 13 and the mobile members 19 according to sensors 16. Also the deformable plates 2, 2' are preferably rotated in a pneumatic manner by two cylinders 23, 23' hinged between the support structure 6 and arms 7, 7', so that the working of the machine is completely automatic since the operator pushes a button of the control panel 17. Finally, a display panel 24 shows the working parameters of the machine according to the present invention, in particular the temperature and the pressure inside the deformable plates 2, 2'.

The pressing device 1 is closed laterally by containers 22, 22' and at the back by the support structure 6, while platform 11 extends frontally; so as to prevent the accidental access to the pressing device 1.

If the semimanufactured product to be waterproofed is a shoe upper, sheath 18 may consist of at least one piece of membrane cut with the size of the inner surface of the upper and folded so as to superimpose two edges thereof near the heel and/or the central front portion of the upper. Said edges are then hot-welded, for example by means of two heated bars, before the pressing, so as to form at least one strip 25 and give to sheath 18 a three-dimensional conformation similar to the upper to be waterproofed. A waterproofing tape is applied, in particular by means of hot-welding, astride strip 25 after the pressing for preventing the water penetration through its edges.

In other embodiments of the present invention, sheath 18 is arranged on the shaped support 14 with the surface provided with glue turned outside, after which the semimanufactured product is arranged on the shaped support 14, so that its inner surface contacts the outer surface of sheath 18 provided with glue. In this case, the glue can be activated during the pressing by heating means, for example one or more electric resistors, arranged in the shaped support 14.

Figure 5:
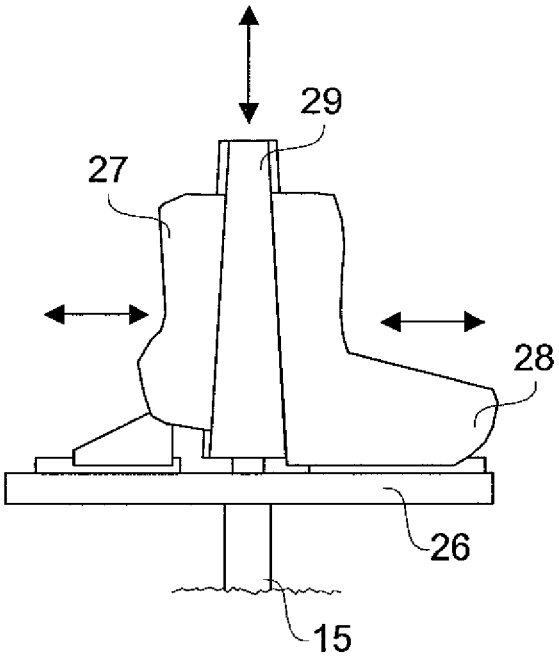
FIG. 5 shows a side view of a second shaped support for the machine of FIG. 1.

Referring to FIG. 5, it is seen that a second shaped support for the process and the machine according to the present invention comprises a horizontal guide 26 arranged on rod 15. A pair of shaped members 27, 28 comprising the heel and the tip, respectively, of a feet can run longitudinally on guide 26 in the direction of the horizontal arrows. A wedge 29 can further slide transversally between the shaped members 27, 28 in the direction of the vertical arrow, so as to move away or near these shaped members 27, 28, for stretching or loosening, respectively, a semimanufactured product, in particular an upper, arranged with its sheath on the shaped members 27, 28.

Figure 6:
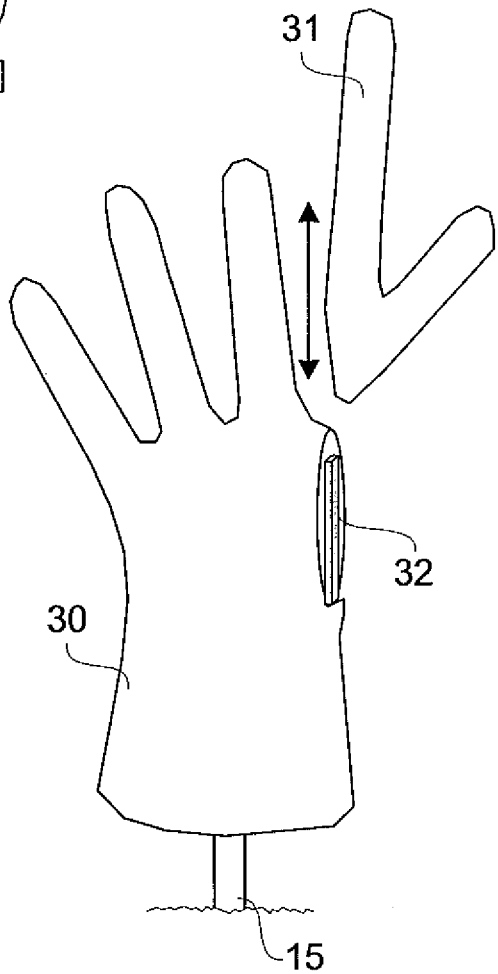
FIG. 6 shows a perspective view of a third shaped support.

Referring to FIG. 6, it is seen that a third shaped support comprises a first shaped member 30 which is arranged on rod 15 and has a shape substantially equal to a hand portion including at least one finger, in particular middle, ring and little fingers. At least one second shaped member 31 having a shape substantially equal to a hand portion including at least one finger, in particular forefinger and thumb, can be mounted onto the first shaped member 30, in particular with a dovetail joint 32, so that it is possible to slip the second shaped member 31 into a glove provided with the sheath and then insert the glove with the second shaped member 31 onto the first shaped member 30 in the direction of the vertical arrow, until the two shaped members 30, 31 are mutually coupled, so as to stretch the glove.

Further changes and/or additions can be made by those skilled in the art to the hereinabove described and illustrated embodiments, while remaining within the scope of the same invention.

What is claimed:

1. A machine for waterproofing semimanufactured footwear, clothing items and accessories, comprising:

a pressing device having at least one pair of deformable plates that are oriented substantially vertically, each deformable plate including a hollow body and a pressing surface that is elastic and suitable for being urged outwards by a fluid under pressure;

a vertically oriented shaped support configured to support a semimanufactured product and a waterproofing sheath arranged on a surface of the semimanufactured product; and a transport means to move the shaped support to and from the pressing device, wherein the transport means includes a first rail and a second rail that converge toward the pressing device, the first rail configured to transport the shaped support to and from a position between the deformable plates of the pressing device, and the second rail configured to transport another shaped support to and from a position between the deformable plates, wherein at least one of said deformable plates is fixed in a mobile manner to a support structure for opening or closing the deformable plates around the shaped support to adhere the waterproofing sheath to the surface of the semimanufactured product.

2. The machine according to claim 1, wherein said pressing device is provided with heating means for activating at least one layer of thermoactivable glue arranged between the semimanufactured product and the waterproofing sheath.

3. The machine according to claim 1, wherein said shaped support is provided with heating means for activating at least one layer of thermoactivable glue arranged between the semimanufactured product and the waterproofing sheath.

4. The machine according to claim 1, wherein one or both deformable plates are pivoted to the support structure so as to rotate for opening or closing the pressing device.

5. The machine according to claim 1, wherein a rotation axis of one or both deformable plates is substantially vertical.

6. The machine according to claim 1, wherein both deformable plates rotate around a same axis.

7. The machine according to claim 1, wherein the at least one pair of deformable plates include a first deformable plate and a second deformable plate, and wherein the pressing device further comprises:

a pair of arms fixed to the first deformable plate; and an arm fixed to the second deformable plate that is arranged between the pair of arms fixed to the first deformable plate.

8. The machine according to claim 7, wherein respective ends of the arms adjacent the support structure include a hole in which a pin is inserted, wherein the pair of deformable plates are configured to rotate around the pin.

9. The machine according to claim 7, wherein respective ends of the arms opposite the support structure include a hole, and wherein the machine further includes a piston to penetrate into the holes of the arms to lock the deformable plates when the deformable plates are closed.

10. The machine according to claim 1, wherein the transport means further includes a first carriage configured to be driven on the first rail, wherein the shaped support is mounted on the first carriage.

11. The machine according to claim 1, wherein the shaped support can be expanded before it is pressed in the pressing device.

12. The machine according to claim 1, wherein the shaped support comprises at least one mobile member suitable for being pushed outwards by one or more cylinders arranged in the same support.

13. The machine according to claim 12, wherein the shaped support is similar to a foot and the mobile member is arranged in the position of the heel.

14. The machine according to claim 13, wherein the mobile member is fixed in a removable manner to the shaped support so as to substitute it with other mobile members having different sizes, so as to adapt the shaped support to shoe uppers having different sizes.

15. The machine according to claim 1, wherein the shaped support comprises a pair of shaped members that are movable with respect to one another.

16. The machine according to claim 15, wherein shapes of said shaped members comprise a heel and a tip, respectively, of a foot.

17. The machine according to claim 1, characterized in that the shaped support comprises a first shaped member on which a second shaped member can be mounted, said second shaped member being suitable for being inserted into the semimanufactured product to be waterproofed before said mounting.

18. The machine according to claim 17, wherein the first and the second shaped members have a shape substantially equal to a hand portion including at least one finger.

19. The machine according to claim 18, wherein the first shaped member includes middle, ring and little fingers and the second shaped member includes forefinger and thumb.

20. The machine according to claim 2, wherein said heating means comprise one or more inlet ducts provided with valves for introducing into the deformable plates compressed air heated by at least one heat exchanger, as well as at least one outlet duct provided with a valve for discharging this compressed air outside.

21. The machine according to claim 2, wherein said heating means comprise one or more heating members arranged inside the deformable plates for heating the fluid contained therein by conduction and convection, as well as the pressing surfaces by irradiation.

22. The machine according to claim 3, wherein said heating means comprise one or more electric resistors arranged in the shaped member.

23. The machine according to claim 2, wherein the devices for the movement of the mobile components of the machine itself are driven in a pneumatic manner.

24. The machine according to claim 1, wherein the outer surface of the shaped support is provided with at least one of an elastic coating, an anti-adherent coating, and a heat-resistant coating.

* * * * *